US005490714A

United States Patent [19]

de Santis

[11] Patent Number: 5,490,714

[45] Date of Patent: Feb. 13, 1996

[54] METAL CRIB STRUCTURE FOR A ROCKING CHAIR SEATING PLANE

[75] Inventor: Alberto de Santis, Santeramo in Colle, Italy

[73] Assignee: Industrie Natuzzi S.p.A., Bari, Italy

[21] Appl. No.: 286,244

[22] Filed: Aug. 8, 1994

[30] Foreign Application Priority Data

Oct. 13, 1993 [IT] Italy ..... RM93U0183

[51] Int. Cl.[6] ..... A47C 3/02; A47D 13/10

[52] U.S. Cl. ..... 297/267.1; 297/270.1; 248/576; 267/89

[58] Field of Search ..... 297/270, 267, 297/266, 265, 264, DIG. 7; 248/576, 577, 575; 267/89, 131, 177

[56] References Cited

U.S. PATENT DOCUMENTS

| | | | |
|---|---|---|---|
| 2,804,128 | 8/1957 | Barath | 267/89 |
| 3,826,457 | 7/1974 | Huot de Longcha | 248/575 |
| 4,029,283 | 6/1977 | Swenson et al. | 248/575 |
| 4,707,026 | 11/1987 | Johansson | 297/270 |
| 4,909,480 | 3/1990 | Mattson | 267/177 |

FOREIGN PATENT DOCUMENTS

RM93U000075 4/1993 Italy .

*Primary Examiner*—Peter M. Cuomo
*Assistant Examiner*—Anthony D. Barfield
*Attorney, Agent, or Firm*—Browdy and Neimark

[57] ABSTRACT

The invention relates to an improved metal crib structure for an armchair, having a fixed frame, constituted by two opposite lateral elements and a front and a back elements; a cradle-shaped seat support frame of the seating plane oscillating about a horizontal oscillation axis on the fixed frame, which has two opposite v-shaped lateral elements and straight front and back elements; two helix springs oppose oscillation, mounted between the fixed frame and the seat support frame the crib structure further a stiffening device for the helix springs and apparatus for locking the seat support frame in a horizontal position.

3 Claims, 2 Drawing Sheets

METAL CRIB STRUCTURE FOR A ROCKING CHAIR SEATING PLANE

BACKGROUND OF THE INVENTION

The invention relates to an improved metal crib structure for a rocking chair seating plane, provided with means for connecting to other parts, such as chair legs or feet, backrests, arms and footrests, all constituent parts of the armchair. The same applicant has made an application for a Utility Model for a seating plane crib of the above type, constituted by a metal structure comprising: a fixed rectangular frame, comprising a pair of opposite lateral elements and a pair of opposite front and back elements; each of the lateral elements exhibiting an upwardly projecting tab bearing horizontally pivoting bolts; a support frame for the seating plane, pivoted on the fixed frame according to the horizontal axis and oscillating about it through a limited angle; at least two antagonist elastic means for oscillating, mounted between the fixed frame and the seat support frame.

The above-mentioned crib has encountered some drawbacks. Among them is the fact that the elastic means, usually helix springs, are not adaptable to the various weights of different people sitting on the rocking chair, so that if the springs are of a rigidity such as to permit of perfectly rocking a person of 50 kilograms in weight, they cannot be readjusted for a person of twice that weight. It would be absurd to think of substituting the springs merely to account for such a very probable eventuality.

Further, the above rocking chair cannot be used as a fixed armchair, so that its range of use is limited, Further still, still with respect to the prior art crib, the pivoting means of the frame of the seating plane on the fixed frame have shown themselves to be poorly effective in solving the typical problems of rocking chairs in the prior art: that is, squeaking during use caused by the friction between the bolts and the pivoting seats, which of course can become very irritating to the user.

The main aim of the present invention is therefore to obviate the above-mentioned drawbacks, by providing a crib structure for an armchair, utilizable both as a rocking chair and as a fixed chair, adaptable to persons of different weight, which at the same time greatly reduces operative squeaks and other irritating noises.

SUMMARY OF THE INVENTION

The invention, as it is characterised in the claims that follow, solves the problem by providing an improved metal crib structure for an armchair, provided with means for connecting to other parts, such as legs or feet, backrest, arms and footrest, comprising a fixed frame, constituted by two opposite lateral elements and a first front element and a back element, which are both straight, each of which lateral elements exhibits an upwardly-projecting rotating and pivoting seat for pivoting bolts on a horizontal axis; a cradle-shaped seat support frame of the seating plane oscillating about the horizontal axis, two opposite v-shaped lateral elements and a second front element and second back element which are both straight welded to free ends of the v-shaped lateral elements, which lateral elements are constrained to the pivoting bolts on the fixed frame on a horizontal axis; two helix springs to oppose oscillation, mounted between the fixed frame and the seat support frame, which is characterised in that it further comprises:

a stiffening device for the helix springs, which springs are constrained by top and bottom coils in truncoconical seats in the fixed frame and the seat support frame; the stiffening element comprising, for each helix spring, means for adjustably blocking a top coil in a truncoconical seat, a bottom coil being fixed in a truncoconical seat in the fixed frame; and a manual lock device for blocking the seat support frame in a horizontal position, comprising a command arm mounted partially rotatably on a hinging group on said fixed frame; said command arm exhibiting at an end opposite to the actuated end, a curved restraining finger which engages with a bar projecting downwardly situated on the second front element of the seat support frame.

In the improved crib structure of the present invention each of the seats for rotating the fixed frame advantageously comprises a tubular housing element of the pivoting bolt, which bolt is thus received in the tubular housing element.

BRIEF DESCRIPTION OF THE DRAWINGS

Further characteristics and advantages of the present invention will better emerge from the detailed description that follows, of a preferred but non-exclusive embodiment here illustrated in the form of a non-limiting example in the accompanying drawings, in which.

DESCRIPTION OF THE PREFERRED EMBODIMENTS

Figure 1:
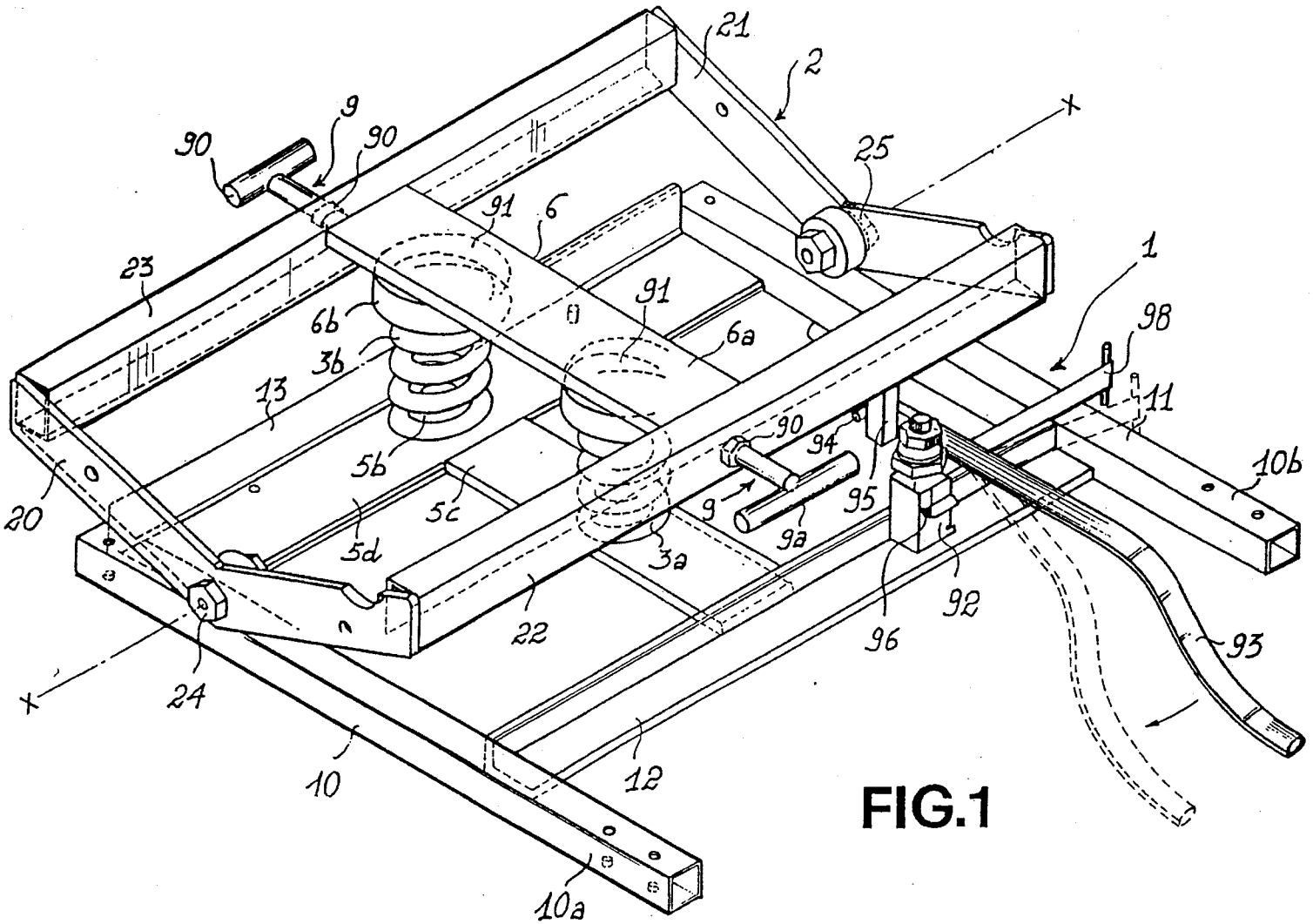
FIG. 1 is a perspective view of an improved crib structure for a seating plane of the rocking chair of the invention.
Figure 2:
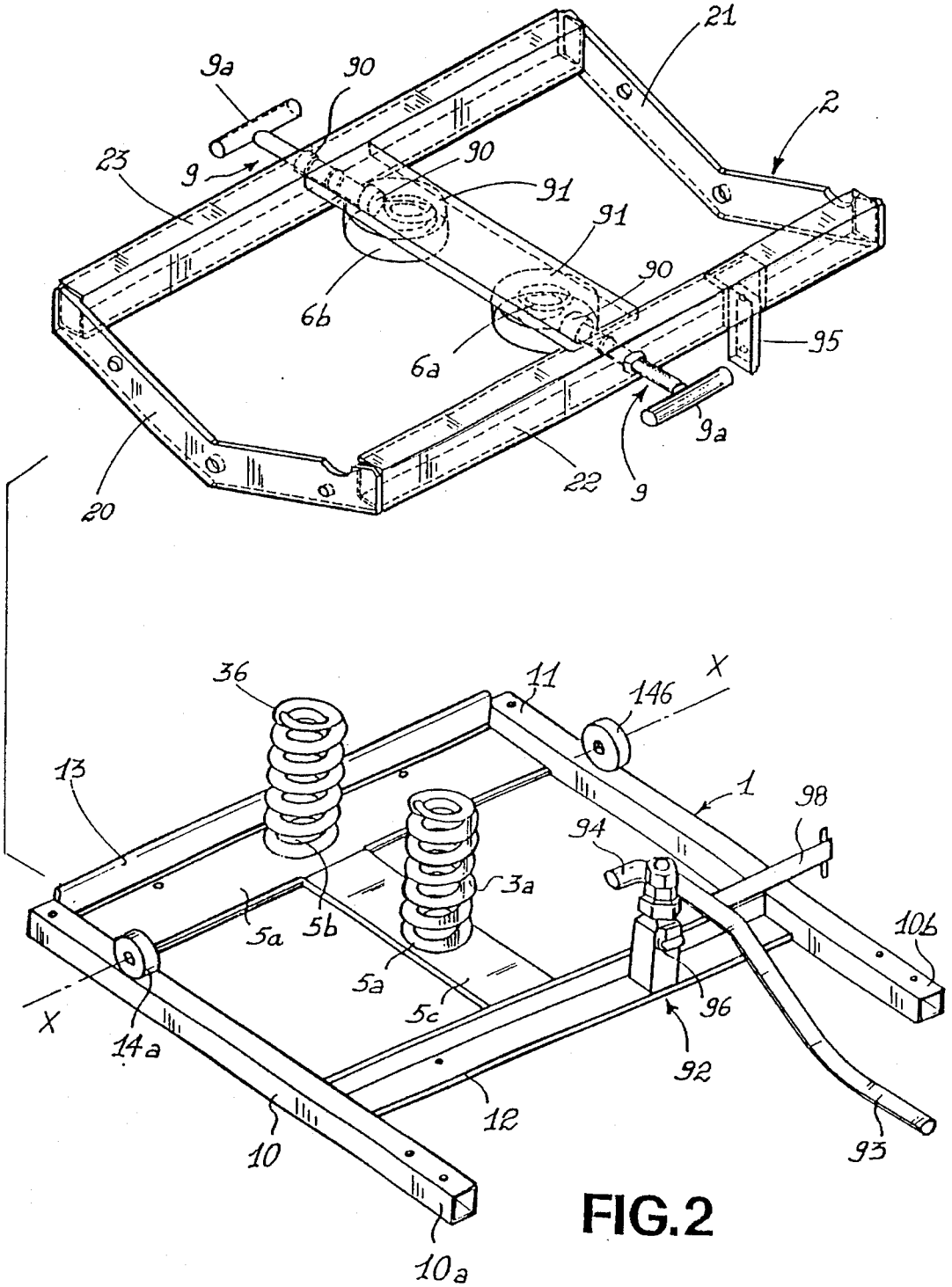
FIG. 2 is an exploded perspective view of the main parts of the invention, namely the fixed frame and the overlying frame of the seating plane.

In the figures, 1 denotes a fixed frame, while 2 denotes a seat support frame of a seating plane: **3*a* and 3*b* indicate helix springs, a combination of the preceding constituting a crib structure for a metal seating plane for an armchair (not illustrated). The crib structure is constrained by screws, bolts or joints to the other parts, namely a possibly-rotatable plate, connected to legs or feet, a backrest, arms and a footrest, all constituent parts of the armchair, all of which elements are not included in the illustrations. The fixed frame 1, usually rectangular in shape, but possibly polygonal having several sides, is constituted by two lateral opposite elements 10 and 11 and by a first front and a back element 12 and 13, all welded together to realize the frame 1. The lateral opposite elements 10 preferably exhibit a closed transversal section, while the first front and back elements 12 and 13 have full L-shaped profiles. The lateral opposite elements 10 also exhibit frontal prolungations 10*a*, 10*b*, with holes to which extendable arms of a footrest are constrained (not illustrated). Each lateral opposite element 10 and 11 affords a rotation bearing 14*a*, 14*b*, projecting upwards and bearing pivoting bolts 24, 25 with a horizontal axis (X—X). Each of the rotating bearings 14*a*, 14*b* of the fixed frame 1 comprises an external tubular housing element, welded to the fixed frame 1 and a rotating bearing for the pivoting bolt which bearing 24, 25** is received in the tubular housing element.

The seat support frame 2 of the seating plane is preferably cradle-shaped and comprises two opposite v-shaped lateral elements 20, 21 and a second front and a back element 22, 23, both straight and welded to free ends of the lateral elements 20, 21. Preferably, the lateral elements 20, 21 of the seat support frame 2 exhibit full profiles, with the second front and back elements, 22 and 23, which have a closed transversal section. At the point of the V, the lateral elements 20 and 21 have through holes and permit housing pivoting bolts 24, 25 for rotatable connection about the horizontal axis X—X between the fixed frame 1 and the seat support frame 2. The rotatable connection allows a limited oscillation angle, as can be seen from FIG. 1. At least two helix springs, a front spring and a back spring, torsion-tensed and compression-activated, and opposing the oscillation, are mounted between the fixed frame 1 and the seat support frame 2 of the seating plane in truncoconical seatings 5*a*, 5*b*, 6*a*, 6*b*, at the ends of the springs 3*a*, 3*b*. The truncoconical seatings, also functioning as endrun stops, are formed in two elongate plates 5*c* and 5*d*, welded to the front and back elements 12 and 13 of the fixed frame 1, as well as in a third elongate plate 6 on the seat support frame 2, which third plate 6 is mounted coplanarly to the plates 5*c* and 5*d*. The plates 5*c* and 6 are perpendicular to the first front and the first back elements of the fixed frame 1 and the seat support frame 2.

The horizontal axis X—X of oscillation is displaced towards the posterior of the fixed frame 1 to facilitate rocking the armchair, while the distance of the spring 3*b* from axis X—X is less than that of the front spring 3*a*, to give a greater sense of safety to the user (that is to convince him or her that he or she will not in any case fall backwards).

The improved crib structure of the invention further comprises a stiffening device of the helix springs 3*a*, 3*b* so that said springs 3*a*, 3*b* can adjust to the different weights of the various users. This stiffening device comprises, for each spring 3*a*, 3*b*, adjustable means for blocking the top coil of the springs 3*a*, 3*b* against the respective truncoconical seating 6*a*, 6*b*, while the bottom coil is fixed conventionally (not illustrated) in its truncoconical seating 5*a*, 5*b* on the fixed frame 1.

The adjustable means for blocking the top coil of each spring comprise a lockscrew 9 with a T-shaped positioning head 9*a*, which engages with threaded coupling elements, usually nuts 90 associated to the second front element and second back element, which are both straight, 22, 23 of the seat support frame 2, in proximity of the springs 3*a*, 3*b*, and passes through the elements 22 and 23. The adjusting means further comprise a circular cap 91 welded below each truncoconical seating 6*a*, 6*b*, for constraining a relative spring 3*a*, 3*b*. The circular cap 91 is provided with a through hole and a threaded coupling for the nuts 90.

To stiffen each helix spring 3*a*, 3*b*, it is sufficient to block the uppermost coil or at least one of the coils nearest to the plate 6, against the relative truncoconical seating 6*a*, 6*b*, by means of the lockscrew 9 through the positioning head 9*a*. In this way, the spring 3*a*, 3*b*, is limited in its deformation and, consequently, is able to resist a greater weight, not deforming more than to a certain degree.

The improved crib structure of the invention comprises a manual blocking device of the seat support: frame 2 in a horizontal position. This blocking device comprises means for hooking mounted partially rotatably on the fixed frame 1, and provides a hinging group 92 of a command arm 93, mounted on the first front element 12 of the fixed frame 1. At the opposite end to the activating end, the command arm 93 exhibits a curved restraining finger 94, which can engage with the bar element 95, welded perpendicularly downwards of the front element 22 of the seat support frame 2. The hinging group 92 can be realized with a threaded pivot on the command arm 93, locknuts being threaded thereon, the lower of which being constrained by an endrun stop 96. To limit its rotation the command arm 93 further has a flat projection 97 with a projection lug 98 which strikes frame 1 when command arm 93 is rotated in the direction of arrow X shown in FIG. 1.

Thanks to this manual blocking device, the rocking chair incorporating the crib structure of the invention, can be blocked with the seating plane in a horizontal position, thus becoming a fixed armchair.

The crib structure, by means of the fixed frame 1 and a possibly rotatable plate (not illustrated) is conventionally constrained to the feet of the rocking chair equipping the crib structure.

What is claimed:

1. An improved metal crib structure for a seating plane of an armchair, comprising:

a fixed frame, constituted by two opposite lateral elements, and a first front element and a first back element, each of which lateral elements having an upwardly-projecting bearing with through holes on a horizontal axis for receiving pivoting bolts;

a cradle-shaped seat support frame of the seating plane, oscillating about the horizontal axis, comprising two opposite v-shaped lateral elements and a second front element and a second back element which are both straight and welded to free ends of the v-shaped lateral elements, the v-shaped lateral elements being respectively rotatably and pivotally engaged to each said upwardly-projecting seat by pivoting bolts engaged in said through holes;

two helix springs for opposing oscillation of the seat support frame mounted between the fixed frame and the seat support frame;

a stiffening device for the helix springs, comprising, for each of the helix springs, means for adjustably blocking a top coil thereof in a trunconical seating on the seat support frame, a bottom coil thereof being blocked in a trunconical seating on the fixed frame wherein the means for adjustably blocking the top coil of each of the helix springs comprises:

a lockscrew having a T-shaped positioning head and coupling with nuts associated with each said second front element and said second back element of the seat support frame, the lockscrew being situated in proximity to each helix spring of said two helix springs and passing through the second front element and second back element; a circular cap welded to and below each trunconical seating on the seat support frame for respectively constraining and end of said each helix spring, the circular cap being provided with a through hole and a threaded coupling for engaging the nuts; and manual lock means for blocking the seat support frame in a horizontal position.

2. The crib structure of claim 1, wherein said manual lock means comprises a command arm having a flat projection with a lug which strikes the fixed frame when the command arm is rotated and the command arm being rotatably hinged on a hinging group mounted on the first front element of the fixed frame;

said command arm having a curved restraining finger at an end opposite from a manual actuating end of the command arm;

a downwardly-projecting element on the second front element, wherein when the seat support frame reaches a horizontal position said downwardly-projecting element can be engaged by said curved restraining finger when said command arm is rotated around said hinging group to maintain said seat support frame in the horizontal position.

3. The crib structure of claim 1, wherein each upwardly-projecting bearing of the fixed frame comprises a tubular housing element welded to the fixed frame, and a bearing for each pivoting bolt of said pivoting bolts, said bearing being received in the tubular housing element.

* * * * *